US010786019B1

(12) United States Patent
Mendoza

(10) Patent No.: US 10,786,019 B1
(45) Date of Patent: Sep. 29, 2020

(54) REFLECTIVE VEST ASSEMBLY

(71) Applicant: Mabel Mendoza, Bremerton, WA (US)

(72) Inventor: Mabel Mendoza, Bremerton, WA (US)

( * ) Notice: Subject to any disclaimer, the term of this patent is extended or adjusted under 35 U.S.C. 154(b) by 0 days.

(21) Appl. No.: 16/562,047

(22) Filed: Sep. 5, 2019

(51) Int. Cl.
*A41D 1/04* (2006.01)
*A41D 13/01* (2006.01)

(52) U.S. Cl.
CPC ..... *A41D 13/01* (2013.01); *A41D 1/04* (2013.01)

(58) Field of Classification Search
CPC ..... A41D 13/01; A41D 1/04
USPC ..... 359/516
See application file for complete search history.

(56) References Cited

U.S. PATENT DOCUMENTS 4,328,533 A 5/1982 Paredes
D280,860 S 10/1985 Monferrato
4,653,853 A 3/1987 Bedford
5,070,436 A 12/1991 Alexander
D382,670 S 8/1997 Sayre
5,695,853 A * 12/1997 Billingsley ..... G08B 5/004 428/171
6,085,698 A 7/2000 Klein
6,267,482 B1 7/2001 Miller
6,698,903 B2 3/2004 Hall
6,820,280 B1 11/2004 Atallah

FOREIGN PATENT DOCUMENTS

WO WO2004057987 7/2004

* cited by examiner

*Primary Examiner* — Euncha P Cherry

(57) ABSTRACT

A reflective vest assembly includes a front disk that is wearable on a user's chest. The front disk is comprised of a fluorescent material to enhance visibility of the user for drivers in traffic. A back disk is wearable on the user's back. The back disk is comprised of a fluorescent material to enhance visibility of the user for drivers in traffic. A shoulder strap is coupled between each of the front disk and the back disk and the shoulder strap is suspended over each of the user's shoulders. A pair of side straps is each coupled between the front disk and the back disk to securing the front disk against the user's chest and to secure the back disk against the user's back.

8 Claims, 4 Drawing Sheets

REFLECTIVE VEST ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to vest device and more particularly pertains to a new vest device for enhancing visibility of a person.

(2) Description of Related Art Including Information Disclosed Under 37 CFR 1.97 and 1.98

The prior art relates to vest device.

BRIEF SUMMARY OF THE INVENTION

An embodiment of the disclosure meets the needs presented above by generally comprising a front disk that is wearable on a user's chest. The front disk is comprised of a fluorescent material to enhance visibility of the user for drivers in traffic. A back disk is wearable on the user's back. The back disk is comprised of a fluorescent material to enhance visibility of the user for drivers in traffic. A shoulder strap is coupled between each of the front disk and the back disk and the shoulder strap is suspended over each of the user's shoulders. A pair of side straps is each coupled between the front disk and the back disk to securing the front disk against the user's chest and to secure the back disk against the user's back.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
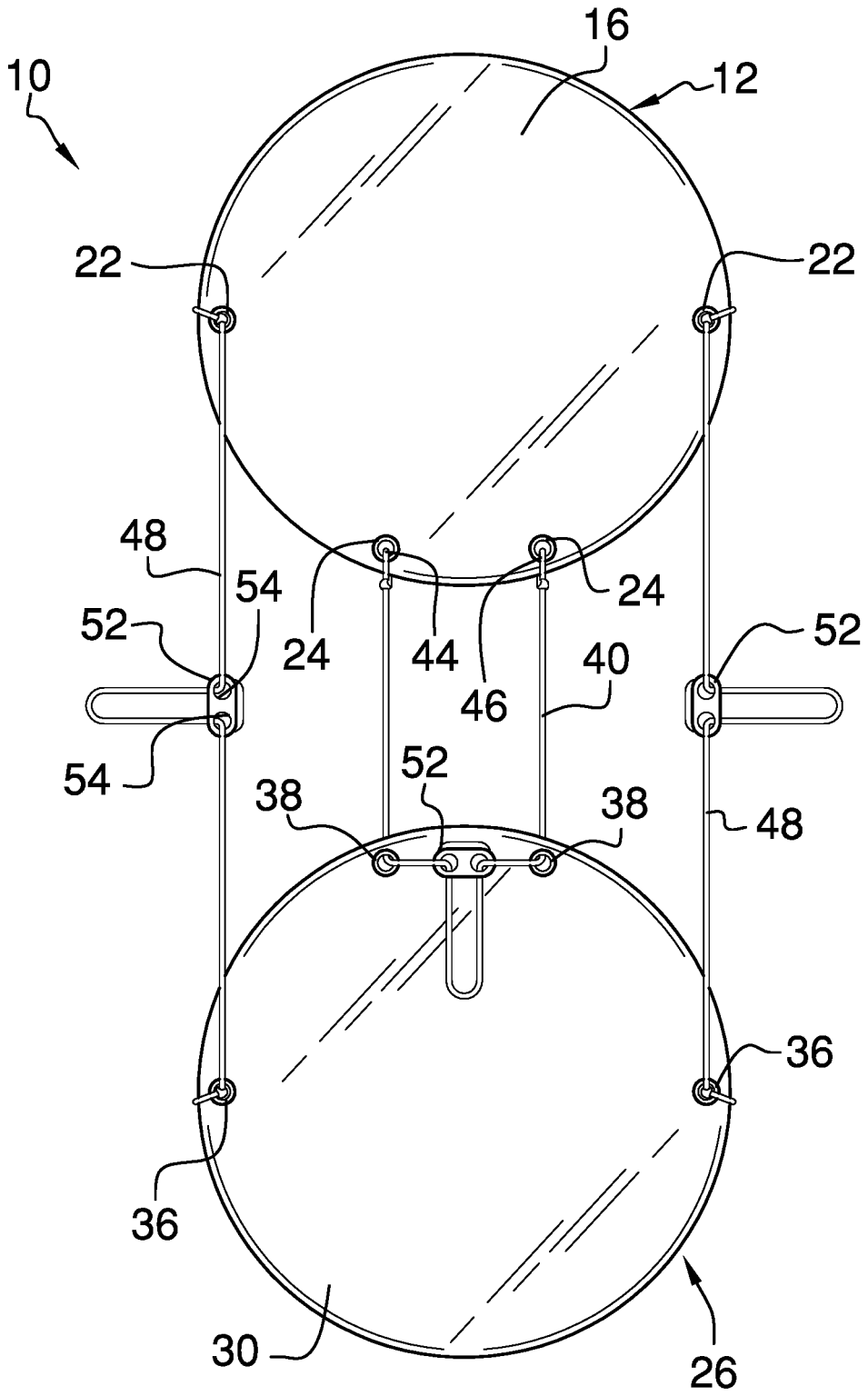
FIG. 1 is a front view of a reflective vest assembly according to an embodiment of the disclosure.
Figure 2:
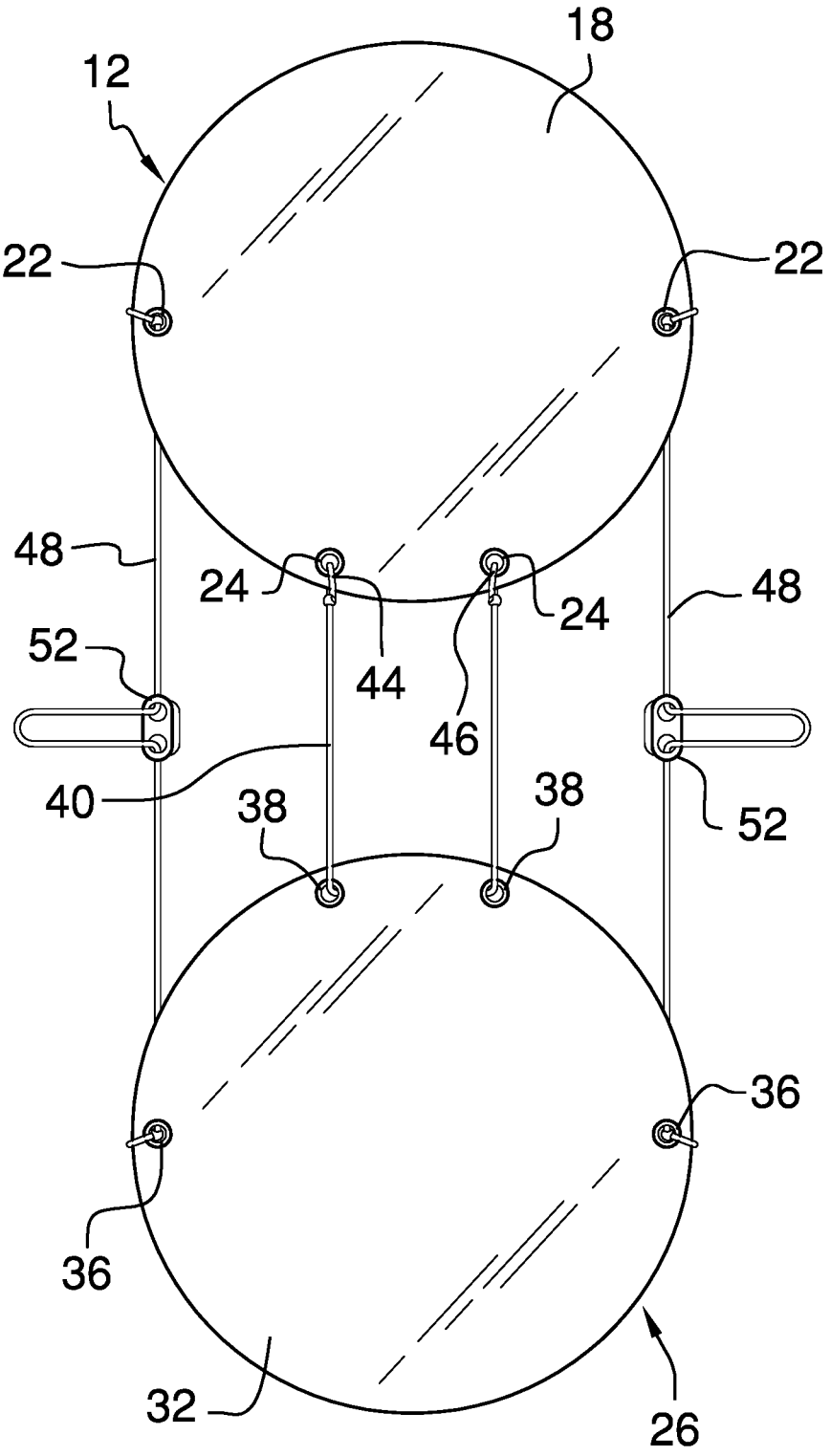
FIG. 2 is a back view of an embodiment of the disclosure.
Figure 3:
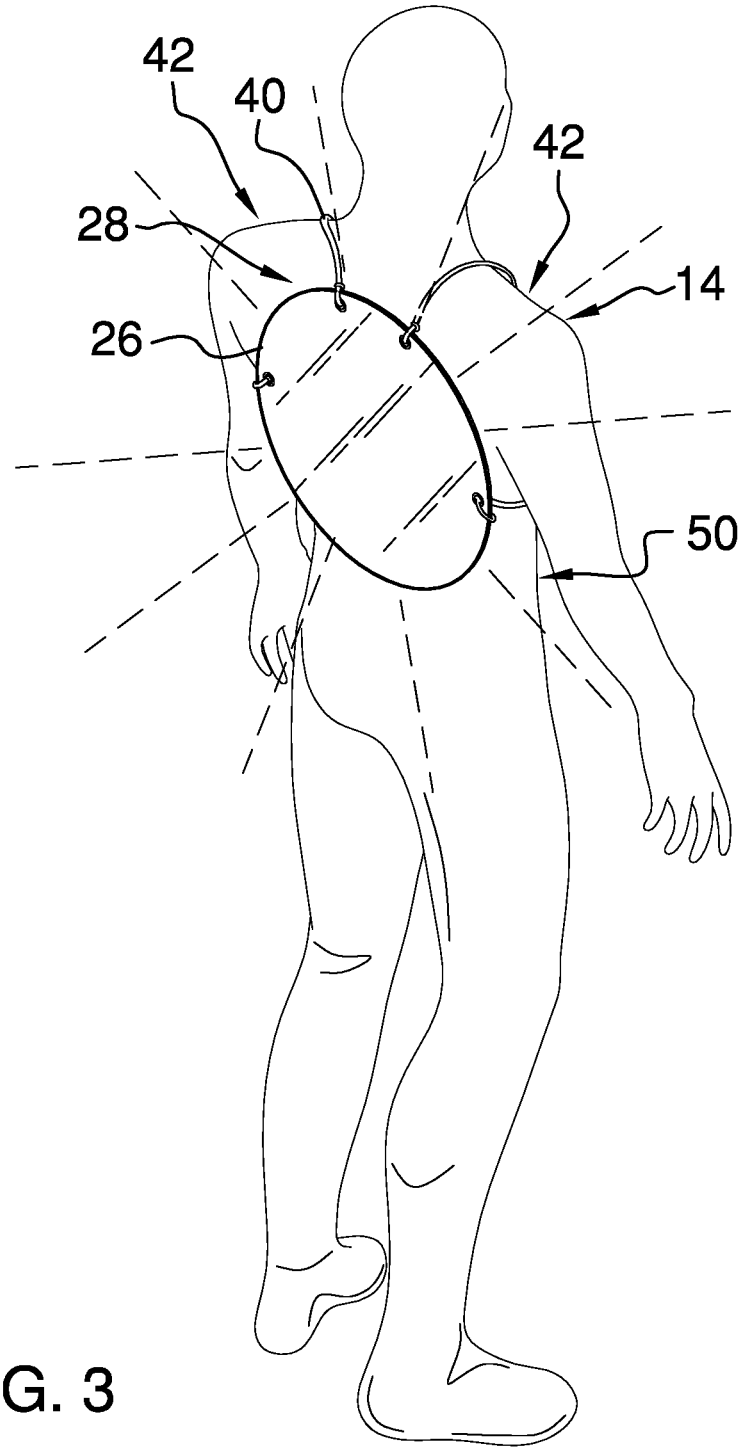
FIG. 3 is a perspective in-use view of an embodiment of the disclosure.
Figure 4:
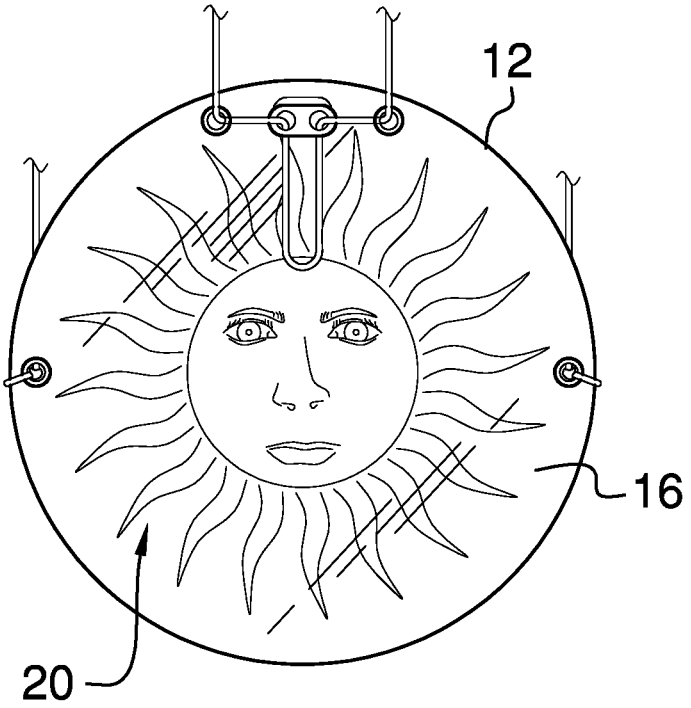
FIG. 4 is a front view of a front disk of an embodiment of the disclosure.
Figure 5:
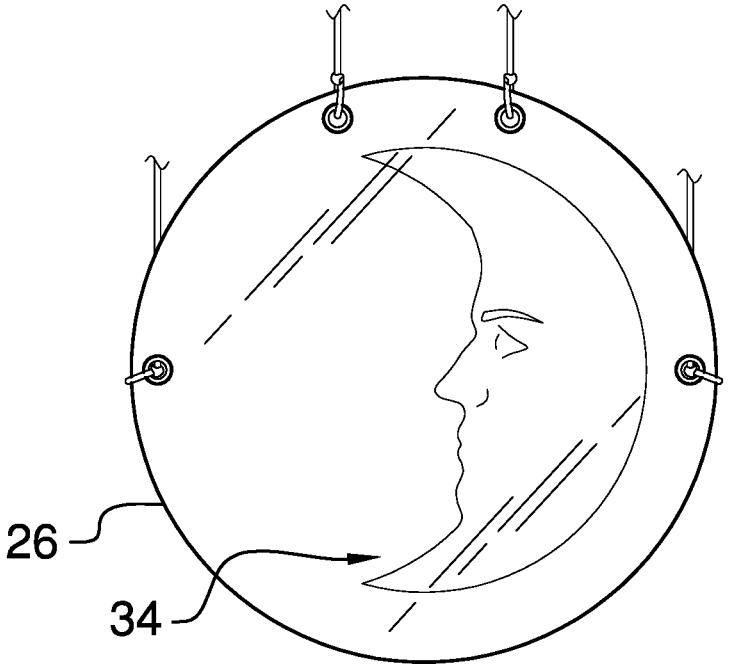
FIG. 5 is a front view of a back disk of an embodiment of the disclosure.

With reference now to the drawings, and in particular to FIGS. 1 through 5 thereof, a new vest device embodying the principles and concepts of an embodiment of the disclosure and generally designated by the reference numeral 10 will be described.

As best illustrated in FIGS. 1 through 5, the reflective vest assembly 10 generally comprises a front disk 12 that is wearable on a user's chest 14. The front disk 12 is comprised of a fabric material, such as nylon or other synthetic material. Additionally, the front disk 12 is comprised of a fluorescent material, or a light reflecting material, thereby facilitating the front disk 12 to fluoresce at night. In this way the front disk 12 enhances visibility of the user for drivers in traffic.

The front disk 12 has a front side 16 and a back side 18, and the front side 16 has a color that is distinct from the color of the back side 18. The color of the front side 16 may be yellow and the color of the back side 18 may be white. Indicia 20 are printed on the front side 16 comprising a predetermined image. The image 20 may be a corporate logo, a sports team logo or any other image.

The front disk 12 has a pair of first apertures 22 extending through the front side 16 and the back side 18. The first apertures 22 are positioned on opposite sides of the front disk 12 from each other. The front disk 12 has a pair of second apertures 24 extending through the front side 16 and the back side 18, and each of the second apertures 24 is positioned between the first apertures 22. The first apertures 22 and the second apertures 24 may be distributed along a perimeter of the front disk 12.

A back disk 26 is included that is wearable on the user's back 28. The back disk 26 is comprised of a fabric material, such as nylon or other synthetic material. The back disk 26 is comprised of a fluorescent material, or a light reflective material, thereby facilitating the back disk 26 to fluoresce at night. In this way the back disk 26 can enhance visibility of the user for drivers in traffic.

The back disk 26 has a forward side 30 and a rear side 32, and the forward side 30 has a color that is distinct from the color of the rear side 32. The color of the forward side 30 may be yellow and the color of the rear side 32 may be white. Indicia 34 are printed on the forward side 30 of the back disk 26 and the indicia on the forward side 30 comprise a predetermined image. The image on the forward side 30 may comprise a corporate logo, a sports team logo or any other image.

The back disk 26 has a pair of primary apertures 36 extending through the forward side 30 and the rear side 32. The primary apertures 36 are positioned on opposite sides of the back disk 26 from each other. Additionally, the back disk 26 has a pair of secondary apertures 38 extending through the forward side 30 and the rear side 32. Each of the secondary apertures 38 is positioned between the primary apertures 36. The primary apertures 36 and the secondary apertures 38 may be distributed along a perimeter of the back disk 26.

A shoulder strap 40 is coupled between each of the front disk 12 and the back disk 26, and the shoulder strap 40 is suspended over each of the user's shoulders 42. In this way the front disk 12 is positioned on the user's chest 14 and has the back disk 26 is positioned on the user's back 28. Thus, each of the front disk 12 and the back disk 26 enhance visibility of the user for drivers in traffic. The shoulder strap 40 has a first end 44 and a second end 46, and the shoulder strap 40 extends through each of the secondary apertures 38 in the back disk 26. Additionally, each of the first end 44 and the second end 46 is secured through a respective one of the second apertures 24 in the front disk 12.

A pair of side straps 48 is provided and each of the side straps 48 is coupled between the front disk 12 and the back disk 26. Each of the side straps 48 extends around the user's waist 50 when the shoulder strap 40 is worn over the user's shoulders 42. In this way the front disk 12 is secured against the user's chest 14 and the back disk 26 is secured against the user's back 28. Each of the side straps 48 is secured between a respective one of the first apertures 22 and a respective one of the primary apertures 36.

A plurality of clasps 52 is provided and each of the clasps 52 has a respective one of the shoulder strap 40 or the side straps 48 extending therethrough. Each of the clasps 52 may have a pair of holes 54 therein and the respective shoulder strap 40 or side straps 48 may pass through each of the holes 54. In this way the respective shoulder strap 40 or side straps 48 can be drawn through the clasps 52. In this way each of the clasps 52 adjusts a length of the respective shoulder strap 40 or the side straps 48.

In use, the shoulder strap 40 is suspended over the user's shoulders to position the front disk 12 on the user's chest 14 and the back disk 26 on the user's back. In this way the front disk 12 and the back disk 26 make the user visible to drivers in traffic while the user is walking adjacent to a roadway or the like. The front side 16 of the front disk 12 is exposed and the forward side 30 of the back disk 26 is exposed during daylight hours. The back side 18 of the front disk 12 is exposed and the rear side 32 of the back disk 26 is exposed during night time hours. Each of the clasps 52 is manipulated to adjust the length of the shoulder strap 40 and the side straps 48.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A reflective vest assembly being configured to be worn on a user to enhance visibility of the user for drivers in traffic, said assembly comprising:

a front disk being wearable on a user's chest, said front disk being comprised of a fabric material, said front disk being comprised of a fluorescent material thereby facilitating said front disk to fluoresce at night wherein said front disk is configured to enhance visibility of the user for drivers in traffic;

a back disk being wearable on the user's back, said back disk being comprised of a fabric material, said back disk being comprised of a fluorescent material thereby facilitating said back disk to fluoresce at night wherein said back disk is configured to enhance visibility of the user for drivers in traffic;

a shoulder strap being coupled between each of said front disk and said back disk, said shoulder strap being suspended over each of the user's shoulders having said front disk being positioned on the user's chest and having said back disk being positioned on the user's back wherein each of said front disk and said back disk are configured to enhance visibility of the user for drivers in traffic;

a pair of side straps, each of said side straps being coupled between said front disk and said back disk, each of said side straps extending around the user's waist when said shoulder strap is worn over the user's shoulders for securing said front disk against the user's chest and securing said back disk against the user's back;

said front disk having a pair of first apertures extending through said front side and said back side, said first apertures being positioned on opposite sides of said front disk from each other, said front disk having a pair of second apertures extending through said front side and said back side, each of said second apertures being positioned between said first apertures;

said back disk having a forward side and a rear side, said forward side having a color being distinct from the color of said rear side, said forward side having indicia being printed thereon comprising a predetermined image, said back disk having a pair of primary apertures extending through said forward side and said rear side, said primary apertures being positioned on opposite sides of said back disk from each other, said back disk having a pair of secondary apertures extending through said forward side and said rear side, each of said secondary apertures being positioned between said primary apertures;

said shoulder strap having a first end and a second end, said shoulder strap extending through each of said secondary apertures in said back disk, each of said first end and said second end being secured through a respective one of said second apertures in said front disk; and each of said side straps being secured between a respective one of said first apertures and a respective one of said primary apertures.

2. The assembly according to claim 1, wherein said front disk has a front side and a back side, said front side having a color being distinct from the color of said back side, said front side having indicia being printed thereon comprising a predetermined image.

3. The assembly according to claim 2, wherein said front disk has a pair of first apertures extending through said front side and said back side, said first apertures being positioned on opposite sides of said front disk from each other.

4. The assembly according to claim 3, wherein said front disk has a pair of second apertures extending through said front side and said back side, each of said second apertures being positioned between said first apertures.

5. The assembly according to claim 1, wherein said back disk has a forward side and a rear side, said forward side having a color being distinct from the color of said rear side, said forward side having indicia being printed thereon comprising a predetermined image.

6. The assembly according to claim 5, wherein said back disk has a pair of primary apertures extending through said forward side and said rear side, said primary apertures being positioned on opposite sides of said back disk from each other.

7. The assembly according to claim 6, wherein said back disk has a pair of secondary apertures extending through said forward side and said rear side, each of said secondary apertures being positioned between said primary apertures.

8. A reflective vest assembly being configured to be worn on a user to enhance visibility of the user for drivers in traffic, said assembly comprising:

a front disk being wearable on a user's chest, said front disk being comprised of a fabric material, said front disk being comprised of a fluorescent material thereby facilitating said front disk to fluoresce at night wherein said front disk is configured to enhance visibility of the user for drivers in traffic, said front disk having a front side and a back side, said front side having a color being distinct from the color of said back side, said front side having indicia being printed thereon comprising a predetermined image, said front disk having a pair of first apertures extending through said front side and said back side, said first apertures being positioned on opposite sides of said front disk from each other, said front disk having a pair of second apertures extending through said front side and said back side, each of said second apertures being positioned between said first apertures;

a back disk being wearable on the user's back, said back disk being comprised of a fabric material, said back disk being comprised of a fluorescent material thereby facilitating said back disk to fluoresce at night wherein said back disk is configured to enhance visibility of the user for drivers in traffic, said back disk having a forward side and a rear side, said forward side having a color being distinct from the color of said rear side, said forward side having indicia being printed thereon comprising a predetermined image, said back disk having a pair of primary apertures extending through said forward side and said rear side, said primary apertures being positioned on opposite sides of said back disk from each other, said back disk having a pair of secondary apertures extending through said forward side and said rear side, each of said secondary apertures being positioned between said primary apertures;

a shoulder strap being coupled between each of said front disk and said back disk, said shoulder strap being suspended over each of the user's shoulders having said front disk being positioned on the user's chest and having said back disk being positioned on the user's back wherein each of said front disk and said back disk are configured to enhance visibility of the user for drivers in traffic, said shoulder strap having a first end and a second end, said shoulder strap extending through each of said secondary apertures in said back disk, each of said first end and said second end being secured through a respective one of said second apertures in said front disk;

a pair of side straps, each of said side straps being coupled between said front disk and said back disk, each of said side straps extending around the user's waist when said shoulder strap is worn over the user's shoulders for securing said front disk against the user's chest and securing said back disk against the user's back, each of said side straps being secured between a respective one of said first apertures and a respective one of said primary apertures; and a plurality of clasps, each of said clasps having a respective one of said shoulder strap or said side straps extending therethrough, each of said clasps adjusting a length of said respective shoulder strap or said side straps.

* * * * *